US005832608A

United States Patent [19]

Pollkötter

[11] Patent Number: 5,832,608

[45] Date of Patent: Nov. 10, 1998

[54] METHOD FOR THE MANUFACTURE OF A ROTATIONALLY SYMMETRICAL PART

[75] Inventor: Günter Pollkötter, Beckum, Germany

[73] Assignee: Leico GmbH & Co. Werkzeugmaschinenbau, Ahlen, Germany

[21] Appl. No.: 832,359

[22] Filed: Apr. 2, 1997

[30] Foreign Application Priority Data

Apr. 16, 1996 [DE] Germany ..... 196 14 993.2

[51] Int. Cl.[6] ..... B21K 1/38; B21D 22/00

[52] U.S. Cl. ..... 29/894.324; 29/894.354; 72/85

[58] Field of Search ..... 29/894.324, 894.32, 29/892.3, 894.354; 72/71, 84, 85; 301/63.1, 65

[56] References Cited

U.S. PATENT DOCUMENTS 5,454,248 10/1995 Inatani ..... 29/894.324

FOREIGN PATENT DOCUMENTS 56-26648 3/1981 Japan ..... 29/894.324

1-90801 4/1989 Japan ..... 301/63.1

*Primary Examiner*—P. W. Echols

*Attorney, Agent, or Firm*—Oblon, Spivak, McClelland, Maier & Neustadt, P.C.

[57] ABSTRACT

The invention relates to a method for the manufacture of a rotationally symmetrical part, particularly a vehicle wheel. The starting material is constituted by a circular blank preform, which has a substantially radial base and a connecting, axial shoulder. The shoulder is firstly rolled out by spinning rollers axially on either side of the base to a first web and a second web. At least one of the two webs is spun against a spinning chuck. Subsequently the outer contour of the webs is finally shaped and calibrated in the outer regions.

7 Claims, 4 Drawing Sheets

METHOD FOR THE MANUFACTURE OF A ROTATIONALLY SYMMETRICAL PART

BACKGROUND OF THE INVENTION

The invention relates to a method for the manufacture of a rotationally symmetrical part, particularly a vehicle wheel, which has a substantially radially directed wheel disk and a substantially axially directed rim, in which use is made of a circular blank preform with a substantially radially directed base and a substantially axially directed shoulder, which is spun by means of spinning rollers against a spinning chuck and is rolled out in the axial direction. Such a method is known from DE 16 52 630 C3. However, the latter method is essentially only suitable for the manufacture of cup-shaped products.

For the manufacture of a motor vehicle wheel or a pulley, use is frequently made of forming or working methods. An important advantage of forming methods is that the end product can be manufactured in non-cutting manner from a blank. Thus, with respect to the manufacture this method is inexpensive and ensures good strength characteristics for the end product.

Motor vehicle wheels normally comprise a wheel disk, on whose circumferential edge two legs or webs extend on either axial side for forming the rim. It is known to manufacture the rim and wheel disks separately and assemble them by means of a screw or welded connection. However, such a vehicle wheel manufacture is relatively expensive.

A method for the manufacture of a one-piece vehicle wheel can e.g. be gathered from DE-32 39 675 C2. In this known method a circular blank is split at its circumferential edge into two legs, which are then formed or worked to the rim. It is a disadvantage of this known method that there is a relatively large number of working steps, which necessarily makes the rim manufacture more expensive. As for different working steps different machines are used or the machines must be correspondingly retooled, the manufacture according to this known method is relatively time-consuming and expensive. In addition, the splitting of a circular blank is not easy from the manufacturing standpoint and can lead to an increased notch effect on the slot base of the two legs.

SUMMARY OF THE INVENTION

The object of the invention is to provide a simple method for the manufacture of a rotationally symmetrical part with good strength characteristics and which is in particular also suitable for the manufacture of vehicle wheels.

For the manufacture of a rotationally symmetrical part, particularly a vehicle wheel, a circular blank preform is provided, which has a substantially radially directed base and on whose circumferential edge there is a substantially radially directed shoulder, which is initially rolled out by means of spinning rollers axially on either side of the base to a first web and a second web, at least one of the two webs being spun against a spinning chuck. Subsequently the outer contour of the webs is finally shaped and calibrated in the outer regions.

According to a first aspect of the invention the starting workpiece is constituted by a cup-shaped circular blank with a disk-like base and an axially directed shoulder or side wall connected thereto. The axially directed shoulder section is so constructed that it has precisely the material quantity necessary for constructing the rim. In a first working step said shoulder is rolled out by means of at least one spinning roller axially on either side of the disk-like base. The spinning roller leads to a wall thickness reduction of the shoulder region and to a corresponding axial extension.

In a further working step one or both webs are drawn in, i.e. spun against a spinning chuck. The spinning chuck has the subsequent inner contour of the rim.

In a further working step the end product is manufactured by a profiling or calibrating operation. This takes place by means of specially constructed profiling or calibrating tools. A desired outer contour of the rim can be set in this working step.

In the method according to the invention, it is particularly advantageous that a vehicle wheel can be manufactured in a few working steps on a spinning roller machine. Through the simultaneous construction of two webs extending in opposite directions from a shoulder region of the circular blank preform, an axially oriented structure is obtained in the material, which prevents a notch effect occurring in the rim bed.

According to a further development of the invention, the first web extends in the shoulder direction and is longer than the second web. In this way in both webs there is a similar stretch ratio and consequently a comparable work hardening.

With a view to a particularly simple working sequence, it is advantageous that the webs are shaped in axially parallel manner. The spinning rollers for the shaping of the webs are moved parallel to the rotation axis of the spinning roller machine and the coaxially fixed circular blank preform.

According to a further development of the invention, it is advantageous that the first and second webs are shaped with different material thicknesses. As the second, smaller web due to the shorter lever arm only has to withstand a lower bending load than the first, longer web, the second web can have relatively small cross-sectional dimensions. A favourable material distribution can be set during the first working step of spin rolling.

Particularly when manufacturing vehicle wheels, it is advantageous that a material thickening is produced during the spin rolling of the webs. A material thickening is necessary for the formation of a hump. Such a material thickening serves as type of safety shoulder on the rim, in order to prevent any displacement of the tyre on the rim e.g. in the case of rapid cornering or sudden air loss in the tyre.

The circular blank preform, which is provided with a hole pattern alongside the circumferential edge bent to one side, can be manufactured in a random manner, e.g. by casting or spinning on the spinning roller machine. However, it is preferable for the circular blank preform to be manufactured by pressing. The circular blank preform can be manufactured by deep drawing or stretch forming on a press. Advantageously, during the pressing process, the desired hole pattern is made in the circular blank preform.

Fundamentally the method according to the invention is suitable for different metallic materials. With regards to the stretching properties it is advantageous for the circular blank preform to be made from an aluminium material, which in particular relates to aluminium alloys.

According to another advantageous embodiment of the invention, prior to the spin rolling, the base of the circular blank preform is shaped as a finished wheel disk. Thus, the circular blank preform base is given the form of the final wheel disk, before said preform is fixed in the spinning roller machine. After performing the method according to the invention, in this way a finished product can be removed from the spinning roller machine.

DESCRIPTION OF THE DRAWINGS

The invention is explained hereinafter relative to the drawings representing the different forming states of a workpiece worked according to the method of the invention and wherein the drawings show.

DETAILED DESCRIPTION OF PREFERRED EMBODIMENTS

Figure 1:
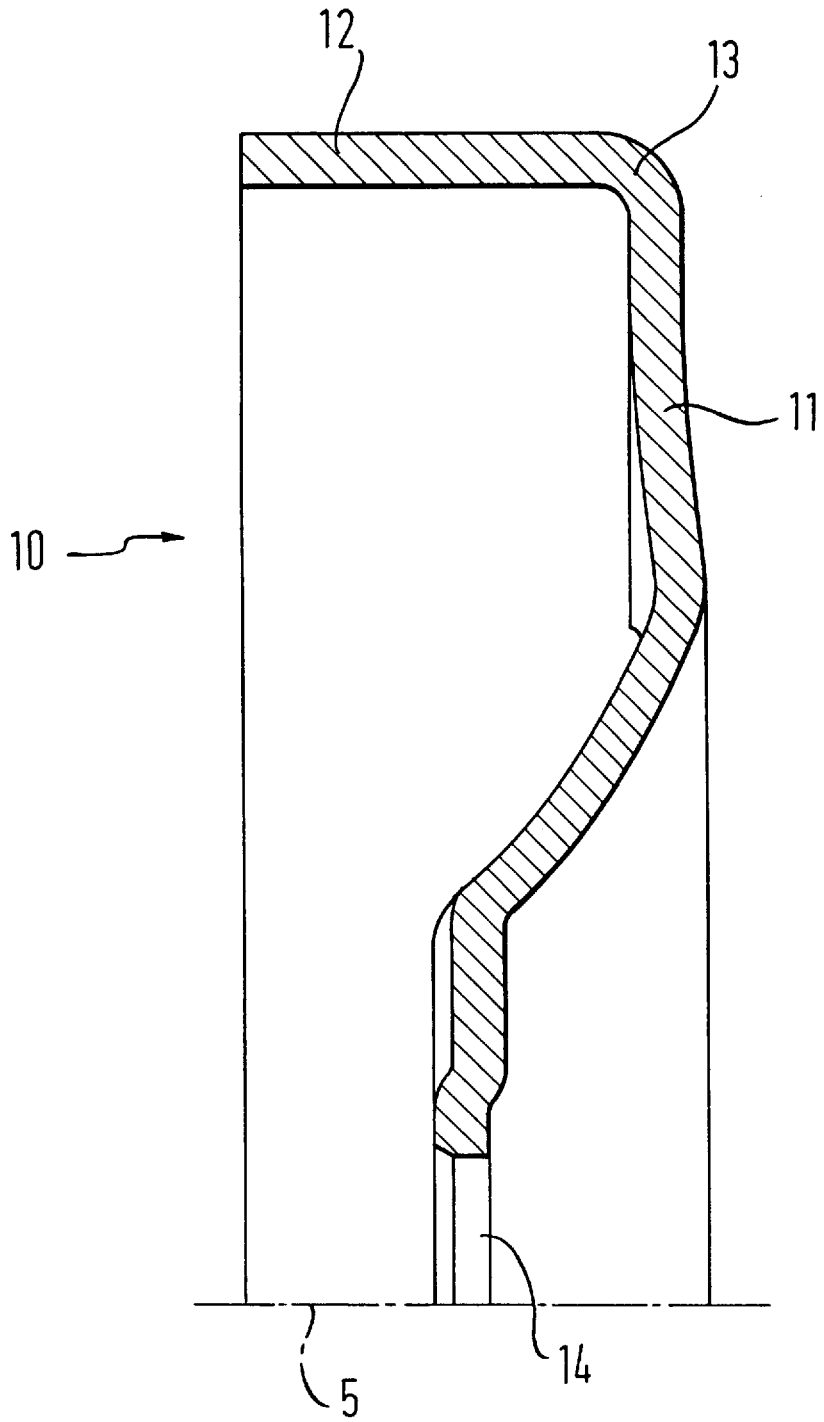
FIG. 1 A part cross-sectional view of the circular blank preform.

FIG. 1 is a part cross-section of a cup-shaped circular blank preform 10 with a substantially radially directed base 11, to which is connected via a bending radius 13 at right angles a shoulder 12. The circular blank preform 10 rotationally symmetrical to the axis 5 was deep drawn on a press in a preceding working step, the base 11 and the shoulder 12 having essentially retained their starting wall thickness. The base 11 is already provided with a contour and a centring opening 14, which correspond to the contour and centring opening of the wheel disk of the end product.

Figure 2:
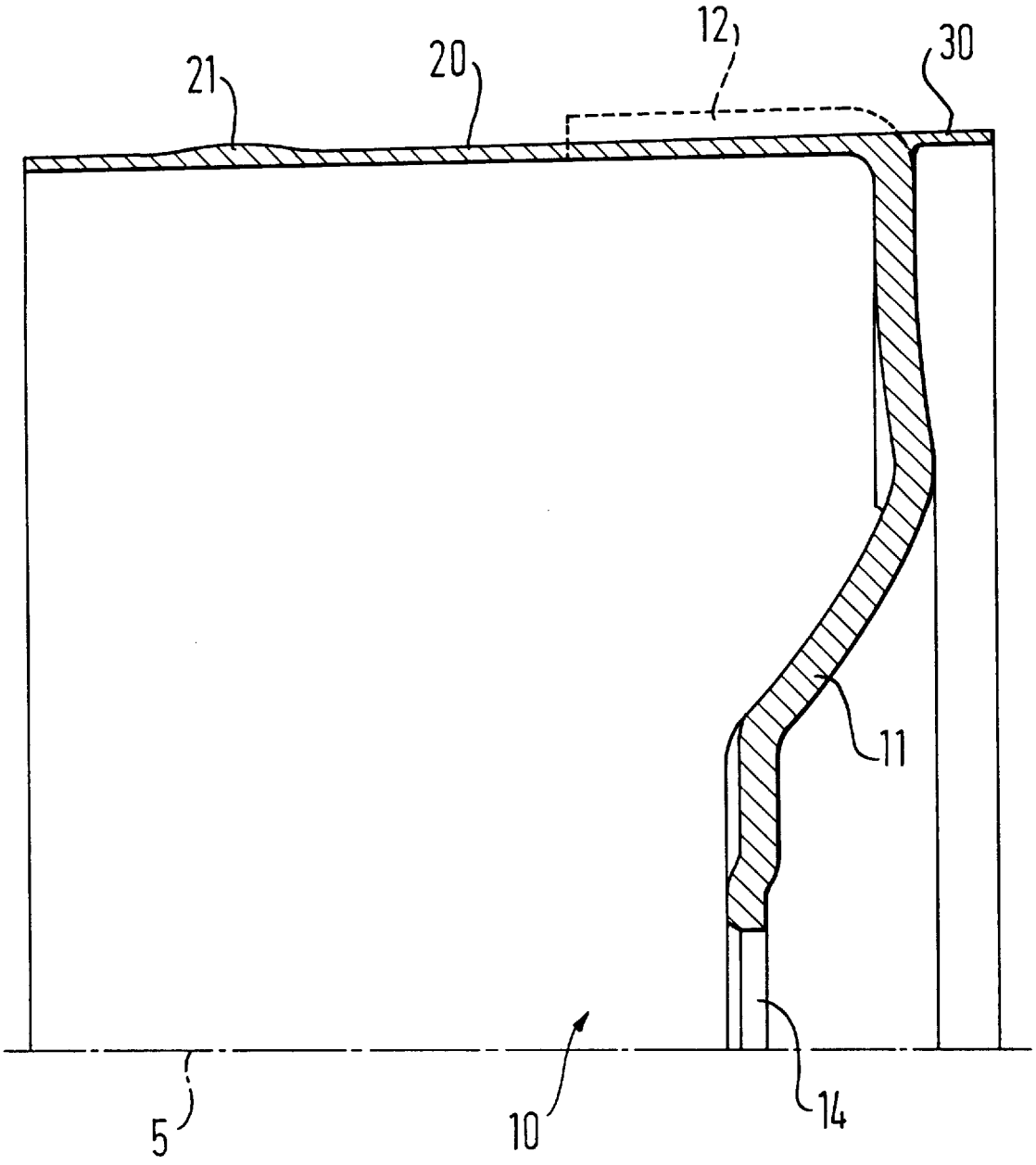
FIG. 2 A part cross-sectional view of a workpiece after the spin rolling process.

Following fixing in a not shown spinning roller machine the shoulder 12, which is shown in broken line form in FIG. 2, is rolled out in a spin rolling process to a first web 20 and to a second web 30 directed axially in opposition thereto. Both webs 20, 30 are substantially parallel to the axis 5. The first web 20, on the left-hand side in this embodiment, extends towards the shoulder 12 and is significantly longer than the second web 30, extending in the opposite direction to the shoulder 12. The first web 20 is provided during the first spin rolling process with a material thickening 21 serving to form a hump on the vehicle wheel. In addition, the wall thickness of the first web 20 decreases from the base 11 to its free end. The wall thickness of the free end of the first web 20 essentially corresponds to the wall thickness of the shorter web 30.

Figure 3:
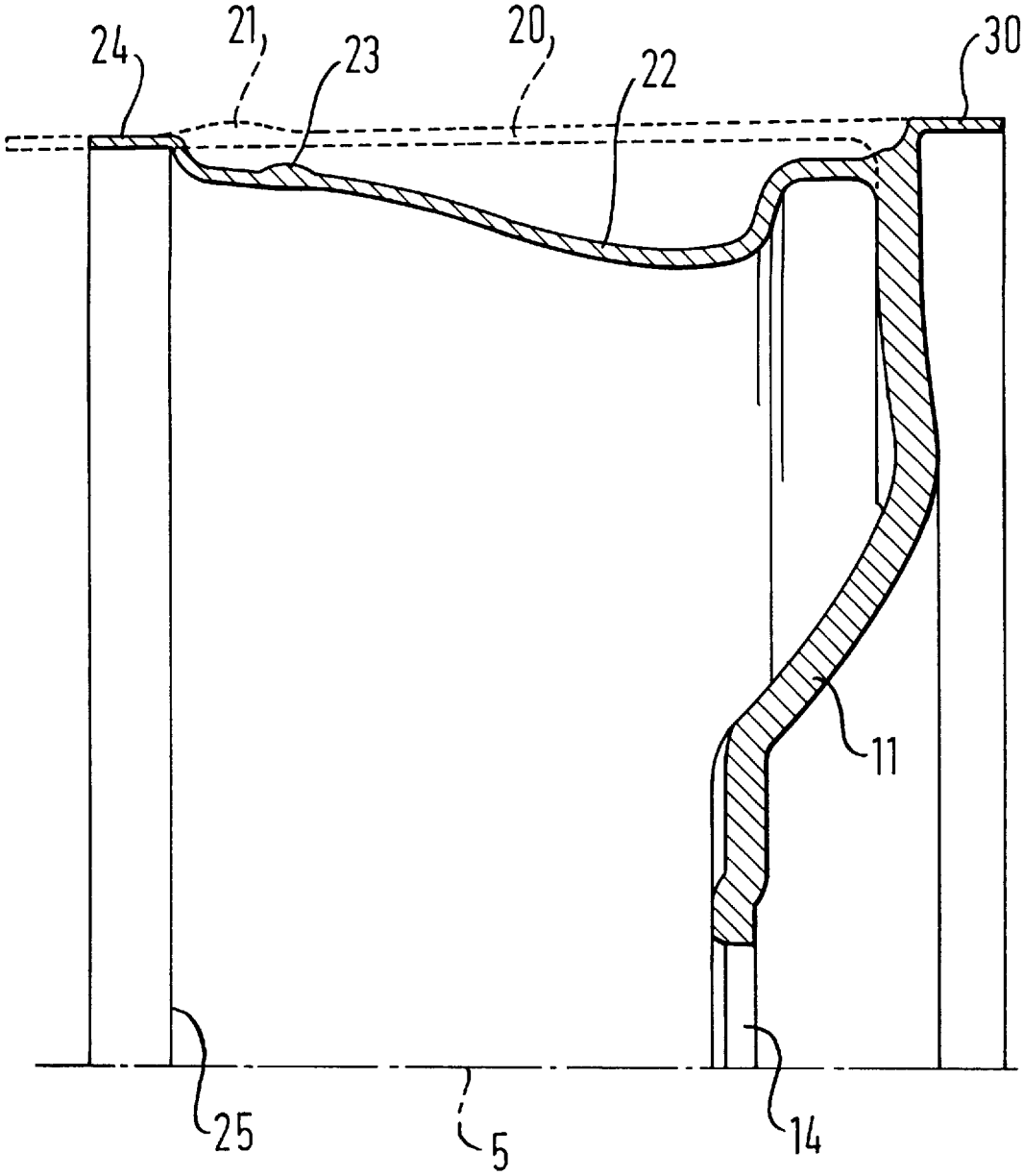
FIG. 3 A part cross-sectional view of the workpiece after drawing in the rim bed.

In another working step, the central region of the first web 20, shown in broken line form in FIG. 3, is spun by means of a spinning roller against a not shown spinning chuck. An edge 25 is formed, which marks the transition of a rim bed 22 to a rim horn section 24 on the free end of the first web 20. The rim horn section 24 is consequently not formed during the drawing in process in the same way as the second web 30. As a result of the drawing in process there is a certain shortening of the first web 20 in the axial direction, the material thickening 21 being displaced to the position of a desired hump shape 23.

Figure 4:
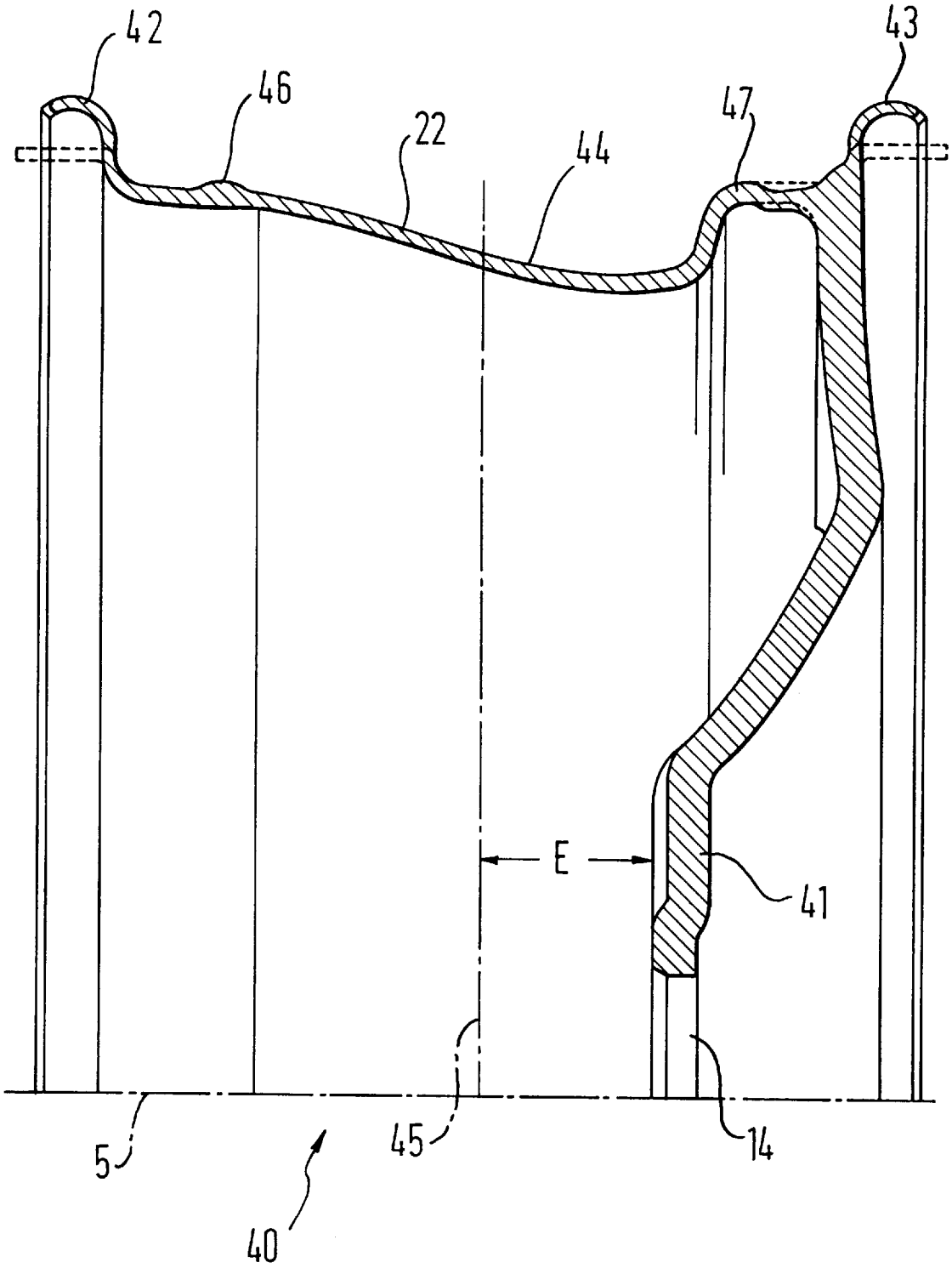
FIG. 4 A part cross-sectional view of the end product.

FIG. 4 shows a finished vehicle wheel 40, which is obtained after the calibration of the outer contour. By means of suitable profiling or calibrating rollers in the vicinity of the rim bed 22 from the hump shape 23 are formed a first hump 46 and a second hump 47 close to the wheel disk 41. Through the shaping of the rim horn section 24 to a rim horn 42 and the second web 30 to a second rim horn 43, the final width and final external diameter of the rim of the vehicle wheel 40 are set.

The method according to the invention is particularly suitable for the manufacture of vehicle wheels 40, in which the wheel disk 41 has a particularly large displacement E towards the width axis 45 of the wheel 40. Obviously the method according to the invention is also suitable for the manufacture of pulleys or other gear parts.

I claim:

1. A method of manufacturing a wheel having a substantially radially directed wheel disk and a substantially axially directed wheel rim extending on two axial sides of the wheel disk from a blank preform having a substantially radially directed base and a substantially axially directed shoulder extending on only one axial side of said base, comprising the sequential steps of:

performing a rolling operation on said substantially axially directed shoulder so as to form a first web extending substantially axially on said one axial side of said base and a second web extending substantially axially on the other axial side of said base;

performing a rolling operation on said first web so as to form the first web in the contour of a wheel rim; and forming the second web and the end of the first web as rim horns.

2. The method of claim 1 wherein said first web is longer than said second web.

3. The method of claim 1 wherein said first web and said second web have different material thicknesses and wherein said first web has a thickened portion.

4. The method of claim 3 wherein said thickened portion of said first web is formed into a hump during said step of forming the first web in the contour of a wheel rim.

5. The method of claim 1 wherein the blank preform is a pressed preform.

6. The method of claim 1 wherein the blank preform is made from an aluminum material.

7. The method of claim 1 wherein the base of the blank preform has the shape of a finished wheel disk.

* * * * *